US006874169B2

(12) United States Patent
Broersma

(10) Patent No.: US 6,874,169 B2
(45) Date of Patent: Apr. 5, 2005

(54) SWIVELING SOUND-GATHERING EAR GUARD FOR MASKS AND HELMETS

(75) Inventor: Lester Broersma, Chula Vista, CA (US)

(73) Assignee: JT USA, LLC, Chula Vista, CA (US)

( * ) Notice: Subject to any disclaimer, the term of this patent is extended or adjusted under 35 U.S.C. 154(b) by 0 days.

(21) Appl. No.: 10/377,036

(22) Filed: Feb. 28, 2003

(65) Prior Publication Data

US 2003/0159199 A1 Aug. 28, 2003

Related U.S. Application Data

(60) Provisional application No. 60/360,643, filed on Feb. 28, 2002.

(51) Int. Cl.[7] ..... A42B 1/08
(52) U.S. Cl. ..... 2/423; 2/209; 181/136
(58) Field of Search ..... 2/209, 423, 425; 181/136, 129, 133

(56) References Cited

U.S. PATENT DOCUMENTS 1,637,692 A * 8/1927 Fitzpatrick et al. ..... 2/423
1,795,866 A * 3/1931 King ..... 2/8
2,242,953 A * 5/1941 House ..... 181/125
3,190,973 A * 6/1965 Aileo ..... 2/423
3,454,962 A * 7/1969 Hind ..... 2/423
3,496,854 A * 2/1970 Hill et al. ..... 454/370
3,500,475 A * 3/1970 Otsuka ..... 2/421
4,357,711 A * 11/1982 Drefko et al. ..... 2/423
4,556,994 A * 12/1985 Kawasaki et al. ..... 2/424
4,581,776 A * 4/1986 Kie ..... 2/425
4,633,532 A * 1/1987 Yagasaki ..... 2/424
5,632,048 A * 5/1997 Mortell et al. ..... 2/423
5,696,356 A * 12/1997 Dudley et al. ..... 181/136
6,073,272 A * 6/2000 Ball ..... 2/423

* cited by examiner

*Primary Examiner*—Rodney M. Lindsey
(74) *Attorney, Agent, or Firm*—Henri J. A. Charmasson; John D. Buchaca

(57) ABSTRACT

A portion of a mask or helmet covering a user's ear has an aperture covered by a sound-collecting and sound-transmissive protector swivelingly mounted thereon. The protector has a substantially parabolic reflector surface oriented substantially perpendicular to the protector's axis of rotation which magnifies sounds arriving from a particular angular direction and directs the sound through a plurality of holes axially penetrating through the protector from an outer to an inner surface. A user manipulable actuator nib extends axially outwardly from a peripheral portion of the outer surface of the protector allowing user control of swiveling movement.

20 Claims, 1 Drawing Sheet

SWIVELING SOUND-GATHERING EAR GUARD FOR MASKS AND HELMETS

This application claims the benefit of Provisional application Ser. No. 60/360,643, filed Feb. 28, 2002.

FIELD OF THE INVENTION

This invention relates to mask and helmet design and manufacture, and more particularly to masks used in the practice of various types of sporting activities such as hockey, baseball, motor-cross, and paintball war games.

BACKGROUND OF THE INVENTION

Many sport practitioners must shield parts of their bodies against harmful impacts. In particular, hockey, baseball, motor-cross and paintball enthusiasts, commonly wear protective masks or helmets which cover and protect their entire heads from such impacts. Such covering, though protective, tends to restrict the passage of sound therethrough. Hearing sounds from the field of play can often determine the next move a player will make. It is therefore important that sound attenuation caused by the mask be minimized.

Existing designs such as those for baseball helmets, provide holes through the mask walls near the user's ears for sound passage. However, in many sports and in motor-cross and paintball gaming in particular, such holes would allow an inordinate amount of either mud or paint through to the user's ear. Further, these existing designs do not selectively boost sounds coming from a particular direction and attenuate sounds from other directions. Further, a user cannot adjust the direction of sound selectivity apart from movement of the user's head.

The present invention results from an attempt to accommodate both ear protection and the adequate passage of sound while providing some user control of sound direction selectivity.

SUMMARY OF THE INVENTION

The principal and secondary objects of this invention are to provide a sports mask or helmet which shields the user's ear from debris while allowing adequate passage of sound therethrough, and provides the user with selectability of direction from which sounds will be boosted and those that will be attenuated.

These and other valuable objects are achieved by a sound-collecting and transmissive protector swivelingly mounted within a circular aperture of a helmet proximate to a user's ear. The protector incorporates a substantially parabolic reflector surface oriented to boost sound pressure levels arriving from a particular direction which is generally perpendicular to the direction which is normal to the surface of the mask. The disk-shaped protector has a series of holes which allow passage of the sound therethrough and a user-manipulable actuator nib positioned on a peripheral portion of the protector to direct rotational movement.

DESCRIPTION OF THE PREFERRED EMBODIMENT OF THE INVENTION

Figure 1:
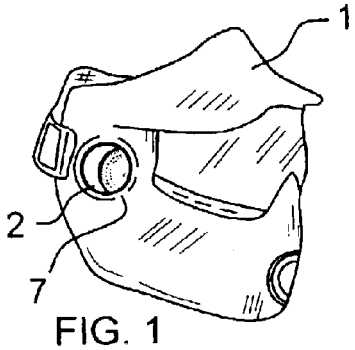
FIG. 1 is a diagrammatic perspective view of the protector as mounted to a paintball mask.
Figure 2:
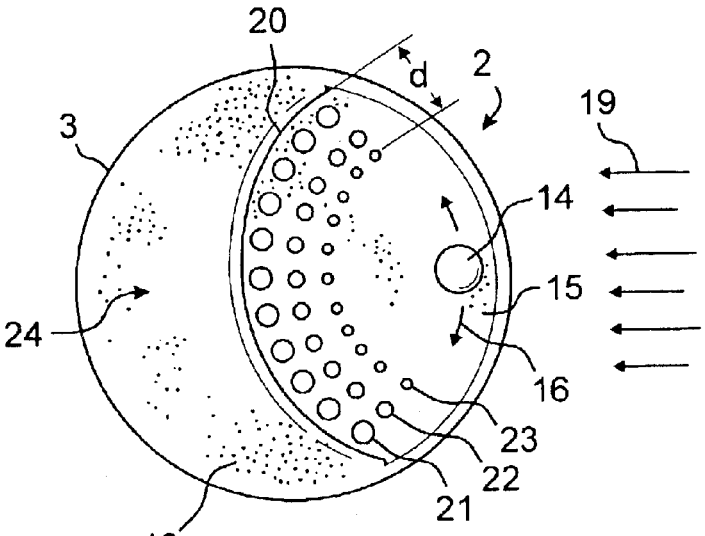
FIG. 2 is a diagrammatic outside plan view of the protector according to the invention.
Figure 4:
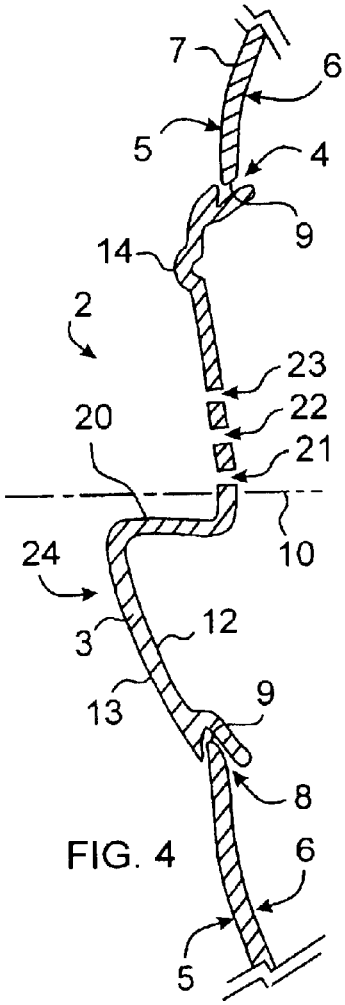
FIG. 4 is a diagrammatic cross-sectional bottom view of the protector shown in FIG. 1.
Figure 3:
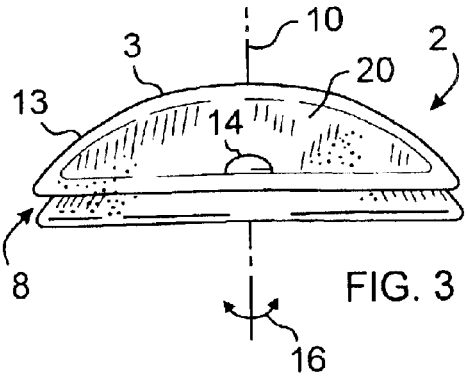
FIG. 3 is a front plan view of the protector of FIG. 2.

Referring now to the drawing, there is shown in FIG. 1 a user's headgear in the form of a paintball mask 1 including an embodiment of the invention designed specifically to provide protection for the user's ear while allowing passage of sound therethrough and providing the user with a means for selecting a direction of boosted sound response. For clarity, in this embodiment, the protector is described while in an angular orientation which boost sounds arriving from in front of a user's face. Those skilled in the art will readily appreciate that the orientation is swivelingly adjustable.

An adjustably mounted protector 2 comprises a substantially disk-shaped body 3 swivelingly mounted within a substantially circular aperture 4 extending through from an outer surface 5 to an inner surface 6 of a portion 7 of a mask located near or positioned over a user's ear. The protector is formed to have a peripheral channel 8 in which rides within the corresponding edge 9 of the aperture in the mask to allow swiveling movement about an axis 10 of rotation which is generally normal to the surface of the mask and thereby intersects it. The protector has, therefore, an inner surface 12 facing the user's ear and an opposite outer surface 13. A user-manipulable actuator nib 14 extends axially outwardly from a peripheral portion 15 of the outer surface of the protector. In this way, a user's finger can touch upon the nib and provide torque for moving the protector in an an angularly adjusting or swiveling motion 16 about the axis 10.

The protector has an outer surface which is formed into a substantially parabolic reflector 20 oriented substantially perpendicular to the axis of rotation 10. The reflector magnifies sound levels for sounds arriving from a particular direction 14 and correspondingly attenuates sound levels arriving from other directions thereby directing sound from the preferred direction onto the holes. A series of holes 21, 22, 23 located in front of the concave side of the reflector and penetrating through from the outer 13 to inner 12 surfaces allow passage of sound therethrough. The size of the holes is selected to allow passage of sound but to reduce the ability of significant amounts of paint, mud or other matter to pass through. Therefore, the diameter of the holes are preferably selected to be between 1 and 5 millimeters and more preferably between 2 and 5 millimeters. Most preferably, the holes will have a range of sizes, wherein a first series or grouping 21 of holes oriented in an arc congruent with the curve of the reflector have a relatively larger diameter and are placed close to the reflector since the raised porton 24 of the protector behind the reflector blocks fluid arriving from behind the reflector. A second 22 and third 23 series or grouping of holes each oriented in an arc have a diameter which is successively reduced as the distance "d" from the reflector surface increases. In other words, hole diameter is inversely proportional to the probability of impacted paint upon the location of the hole. In this way, the cummulative size of the holes can be maximized for sound through-put while maintaining the adequate protection from the passage of particulate matter according to the probablistic direction of incidence of that matter.

Figure 5:
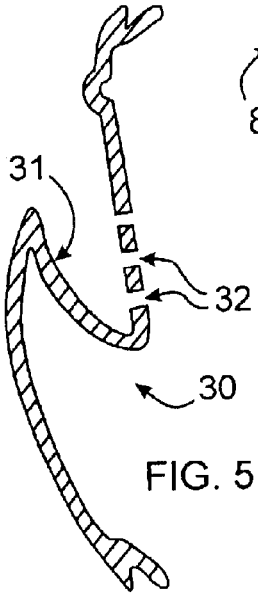
FIG. 5 is a diagrammatic cross-sectional bottom view of a alternate embodiment of the protector according to the invention.

Referring now to FIG. 5, there is shown an alternate embodiment of the protector 30 wherein the reflector is formed to have a reflective surface 31 which extends radially to axially cover over the holes 32 to provide additional protection and greater selectivity of sound reinforcement. The protector is preferably injected molded from a durable rigid plastic material such as polyvinyl chloride. For injecting molding purposes, the embodiment of FIGS. 1–4 is preferable to reduce manufacturing costs.

While the preferred embodiments of the invention have been described, modifications can be made and other embodiments may be devised without departing from the spirit of the invention and the appended claims:

What is claimed is:

1. A sound transmissive ear protector for protective headgear, said protector comprises:

a body having an outer surface and an inner surface;

said body being formed to have a plurality of holes extending between said outer and inner surfaces; and a reflector structure mounted to said outer surface;

wherein a diameter of each of said holes is inversely proportional to its distance from said reflector structure.

2. The protector of claim 1, wherein said protector further comprises a user manipulable actuator for angularly adjusting said body.

3. The protector of claim 1, wherein said reflector structure is oriented to direct sound arriving from a first direction onto said holes.

4. The protector of claim 1, wherein said reflector structure has a substantially parabolic shape.

5. A sound transmissive ear protector for protective headgear, said protector comprises:

a body having an outer surface and an inner surface;

said body being formed to have a plurality of holes extending between said outer and inner surfaces; and a reflector structure mounted to said outer surface;

wherein said reflector structure is shaped to have a first surface extending to axially cover over a first subset of said plurality of holes.

6. The protector of claim 5, wherein said protector further comprises a user manipulable actuator for angularly adjusting said body.

7. The protector of claim 5, wherein said reflector structure is oriented to direct sound arriving from a first direction onto said holes.

8. The protector of claim 5, wherein said reflector structure has a substantially parabolic shape.

9. The protector of claim 5, wherein a first grouping of said holes has a first diameter and a second grouping of said holes has a second diameter smaller than said first diameter.

10. The protector of claim 9, wherein said first and second diameters range between about 2 and about 5 millimeters.

11. The protector of claim 9, wherein said first grouping of said holes is located closer to said reflector structure than said second grouping.

12. The protector of claim 9, wherein said first grouping of holes is further located to form an arc.

13. A sound transmissive ear protector for protective headgear, said protector comprises:

a body having an outer surface and an inner surface;

said body being formed to have a plurality of holes extending between said outer and inner surfaces; and a reflector structure mounted to said outer surface;

wherein said body is substantially disc shaped and is swivelingly mounted within a substantially circular aperture in said headgear.

14. The protector of claim 13, wherein said protector further comprises a user manipulable actuator for angularly adjusting said body.

15. The protector of claim 13, wherein said reflector structure is oriented to direct sound arriving from a first direction onto said holes.

16. The protector of claim 13, wherein said reflector structure has a substantially parabolic shape.

17. The protector of claim 13, wherein a first grouping of said holes has a first diameter and a second grouping of said holes has a second diameter smaller than said first diameter.

18. The protector of claim 17, wherein said first and second diameters range between about 2 and about 5 millimeters.

19. The protector of claim 17, wherein said first grouping of said holes is located closer to said reflector structure than said second grouping.

20. The protector of claim 17, wherein said first grouping of holes is further located to form an arc.

* * * * *